US007329107B2

(12) United States Patent
Hwang et al.

(10) Patent No.: US 7,329,107 B2
(45) Date of Patent: Feb. 12, 2008

(54) OIL SUPPLY STRUCTURE FOR SLIDER OF ORBITING VANE COMPRESSOR

(75) Inventors: Seon-woong Hwang, Anyang-Si (KR); Dong-won Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 69 days.

(21) Appl. No.: 11/208,718

(22) Filed: Aug. 23, 2005

(65) Prior Publication Data

US 2006/0177337 A1 Aug. 10, 2006

(30) Foreign Application Priority Data

Feb. 4, 2005 (KR) ..... 10-2005-0010654

(51) Int. Cl.
*F01C 1/02* (2006.01)
*F01C 1/063* (2006.01)

(52) U.S. Cl. ..... 418/54; 418/59; 418/64; 418/65

(58) Field of Classification Search ..... None
See application file for complete search history.

(56) References Cited

U.S. PATENT DOCUMENTS 4,737,088 A * 4/1988 Taniguchi et al. ..... 418/63
4,874,302 A * 10/1989 Kobayashi et al. ..... 415/55.3
6,132,195 A * 10/2000 Ikoma et al. ..... 418/67
6,352,418 B1 * 3/2002 Kohsokabe et al. ..... 418/61.1
6,409,488 B1 * 6/2002 Ikoma et al. ..... 418/67
6,719,545 B2 * 4/2004 Iizuka ..... 418/55.3
2005/0220651 A1 * 10/2005 Tsukamoto et al. ..... 418/55.3

OTHER PUBLICATIONS

U.S. Appl. No. 11/208,721 to Hwang et al., which was filed on Aug. 23, 2005.
U.S. Appl. No. 11/208,722 to Hwang et al., which was filed on Aug. 23, 2005.

* cited by examiner

*Primary Examiner*—Thomas Denion
*Assistant Examiner*—Douglas J. Duff
(74) *Attorney, Agent, or Firm*—Greenblum & Bernstein, P.L.C.

(57) ABSTRACT

Disclosed herein is an oil supply structure for a slider of an orbiting vane compressor capable of providing effective lubrication to reciprocating surfaces of the slider reciprocating in an annular space of a compressor cylinder. The oil supply structure comprises an oil supply slot formed at an upper surface of an inner ring provided in the cylinder to supply oil to outer surfaces of the slider, and oil grooves formed at the outer surfaces of the slider to guide the oil, supplied through the oil supply slot, along the outer surfaces of the slider. The oil supply structure achieves effective lubrication of the reciprocating surfaces of the slider to thereby reduce friction between the slider and the cylinder, resulting in improved compressor performance.

10 Claims, 6 Drawing Sheets

PRIOR ART

PRIOR ART

OIL SUPPLY STRUCTURE FOR SLIDER OF ORBITING VANE COMPRESSOR

BACKGROUND OF THE INVENTION

1. Field of the Invention

The present invention relates to orbiting vane compressors, and more particularly, to an oil supply structure for a slider of an orbiting vane compressor that is capable of providing effective lubrication to reciprocating surfaces of the slider reciprocating in an annular space of a compressor cylinder.

2. Description of the Related Art

FIG. 1 illustrates the interior configuration of a general orbiting vane compressor. Referring to FIG. 1, the orbiting vane compressor generally comprises a shell 1 configured such that refrigerant gas is introduced through a lower refrigerant suction tube 1*a* and is discharged to the outside of the shell 1 through an upper refrigerant discharge tube 1*b*. A crankshaft 6 is vertically mounted in the shell 1 to be rotatably supported by means of upper and lower flanges 7 and 7*a*. The crankshaft 6 has an eccentric unit 6*a* at the lower portion thereof. A drive unit D and a compression unit P are also mounted in the shell 1 at the upper and lower portions of the crankshaft 6. The drive unit D includes a stator 2, and a rotor 3 disposed in the stator 2 to drive the crankshaft 6 upon receiving electric current. The compression unit P includes an orbiting vane 4 coupled to the eccentric unit 6*a* of the crankshaft 6, and a cylinder 5 disposed beneath the orbiting vane 4. The orbiting vane 4 has a circular vane 4*a*, which performs an orbiting movement in an annular space 5*a*, defined between an inner ring 5*b* and the inner wall of the cylinder 5, according to a rotation of the crankshaft 6. As a result of the orbiting movement, refrigerant gas, introduced into the cylinder 5 through an inlet 5*c* formed at one side of the cylinder 5, is compressed and discharged to the interior of the shell 1.

After being compressed in the annular space 5*a* of the cylinder 5 through the orbiting movement of the orbiting vane 4, the refrigerant gas is discharged to a muffler 8, which encloses a lower surface of the lower flange 7*a*, by passing through the cylinder 5 and the lower flange 7*a*, thereby being discharged to the interior of the shell 1 via a discharge pipe 9 provided at the muffler 8.

FIG. 2 is an exploded perspective view illustrating the compression unit P of the general orbiting vane compressor. Referring to FIG. 2, as stated above, the compression unit P of the conventional orbiting vane compressor includes the cylinder 5 disposed in the lower region of the compressor and having the annular space 5*a* defined between the inner ring 5*b* and the inner wall of the cylinder 5, and the orbiting vane 4 having the circular vane 4*a* and a boss 4*b* formed at the lower surface of a vane plate 4*c* to be inserted respectively into the annular space 5*a* and the inner ring 5*b*, the orbiting vane 4 performing an orbiting movement. The compression unit P further includes a slider 70 inserted into the annular space 5*a* to perform a reciprocating movement while coming into close contact at a lateral surface thereof with a linear lateral edge of the circular vane 4*a* defining an opening 41*a*.

The annular space 5*a* includes a linear portion 51*a* in one end region thereof. The slider 70 is inserted in the linear portion 51*a* such that the lateral surface thereof comes into close contact with the linear lateral edge of the circular vane 4*a* defining the opening 41*a*. As the circular vane 4*a* performs an orbiting movement, the slider 70 linearly reciprocates in the linear portion 51*a*.

The slider 70 configured as stated above serves to isolate a pair of compression chambers, defined at the inside and the outside of the circular vane 4*a*, from each other as it is disposed in the opening 41*a* of the circular vane 4*a*. The slider 70 performs a reciprocating movement while coming into close contact with the linear lateral edge of the circular vane 4*a* defining the opening 41*a*, the inner wall of the cylinder 5 at the linear portion 51*a* of the annular space 5*a*, and the lower surface of the vane plate 4*c*.

The conventional orbiting vane compressor, however, has a problem in that it fails to provide effective lubrication to respective reciprocating surfaces of the slider, resulting in excessive friction at the reciprocating surfaces. Such an excessive friction consequently deteriorates the reliability and performance of the compressor.

SUMMARY OF THE INVENTION

Therefore, the present invention has been made in view of the above problems, and it is an object of the present invention to provide an oil supply structure for a slider of an orbiting vane compressor which can provide effective lubrication to reciprocating surfaces of the slider reciprocating in an annular space of a compressor cylinder.

It is another object of the present invention to provide an oil supply structure for a slider of an orbiting vane compressor which can allow oil, supplied to the slider, to be smoothly discharged to the outside of a compressor cylinder.

In accordance with the present invention, the above and other objects can be accomplished by the provision of an oil supply structure for a slider of an orbiting vane compressor, the compressor comprising: a cylinder having an annular space defined between an inner ring and an inner wall of the cylinder; an orbiting vane having a circular vane and a boss inserted in the annular space and the inner ring of the cylinder, respectively, to perform an orbiting movement, the orbiting vane being adapted to compress refrigerant gas introduced into the cylinder according to a rotating movement of a crankshaft included in the compressor; and the slider inserted in the annular space to perform a reciprocating movement while coming into close contact at a lateral surface thereof with a lateral edge of the circular vane defining an opening, wherein the oil supply structure comprises: an oil supply slot to supply oil to outer surfaces of the slider; an oil groove portion formed at the outer surfaces of the slider to guide the oil, supplied through the oil supply slot, along the overall outer surfaces of the slider; and an oil discharge channel to discharge the oil, guided along the oil groove portion, to the outside of the cylinder.

Preferably, the oil supply slot may be formed at an upper surface of the inner ring of the cylinder to allow the oil filled in the inner ring to be pumped and supplied to the oil groove portion according to an orbiting movement of the boss of the orbiting vane.

Preferably, the oil groove portion may include horizontal oil grooves formed at upper and lower surfaces of the slider, and vertical oil grooves formed at front and rear surfaces of the slider to be connected to the horizontal oil grooves.

Preferably, the oil discharge channel may be perforated through the cylinder at a lower end of the annular space corresponding to a lower end of the oil groove portion.

Preferably, the oil groove portion further may include one or more storage grooves formed at the outer surfaces of the slider to be connected to the oil grooves to store the oil guided along the oil grooves.

Preferably, the oil supply slot may be positioned lower than the horizontal oil groove formed at the upper surface of the slider.

Preferably, the storage grooves may include horizontal storage grooves formed at the upper and lower surfaces of the slider by enlarging the center of the respective horizontal oil grooves, and vertical storage grooves formed at the front and rear surfaces of the slider by enlarging the center of the respective vertical oil grooves.

Preferably, an inclined wall surface may be formed between bottom surfaces of the oil grooves and storage grooves and the outer surfaces of the slider.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be explained with reference to the accompanying drawings.

Figure 1:
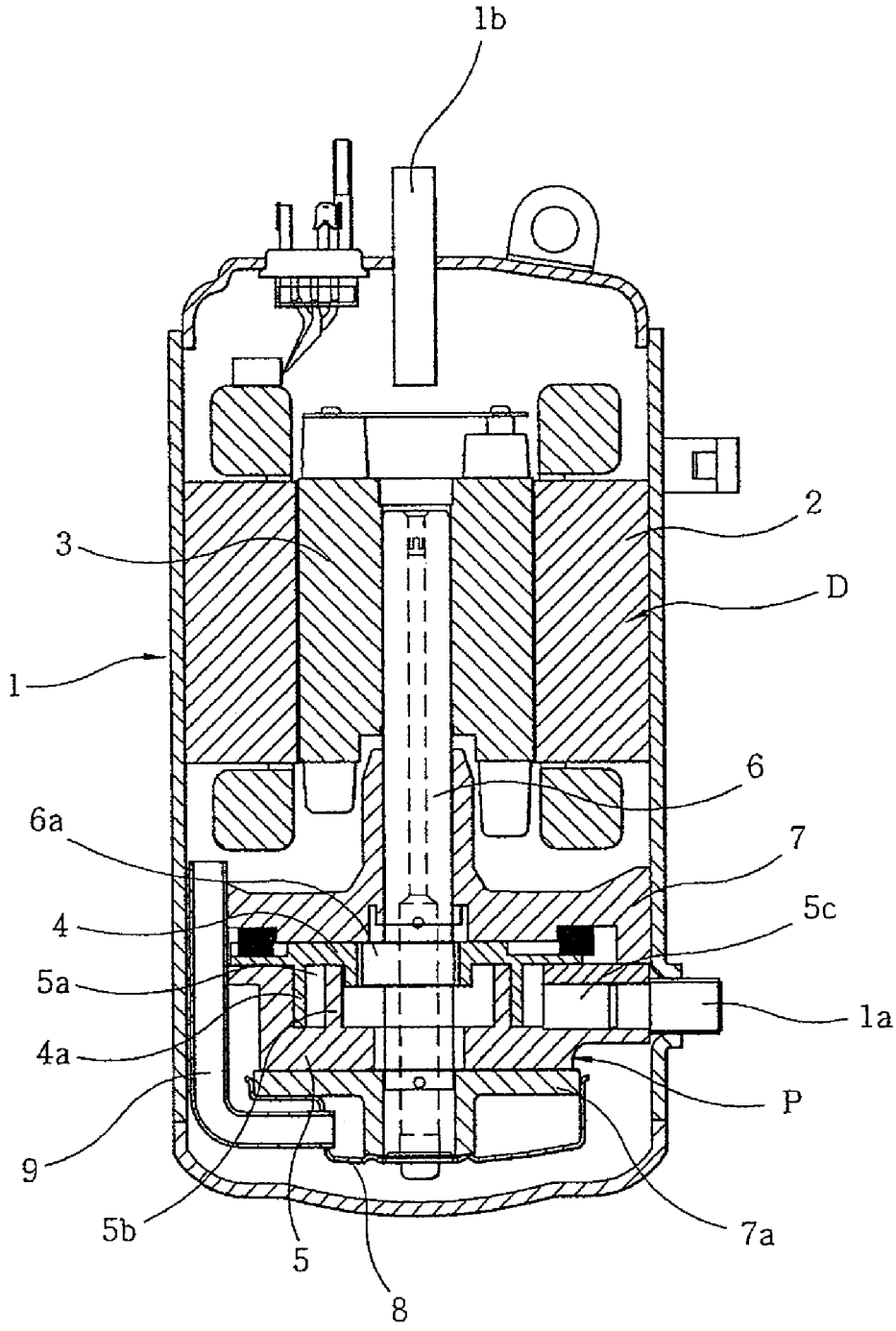
FIG. 1 is a longitudinal sectional view of a conventional orbiting vane compressor.
Figure 2:
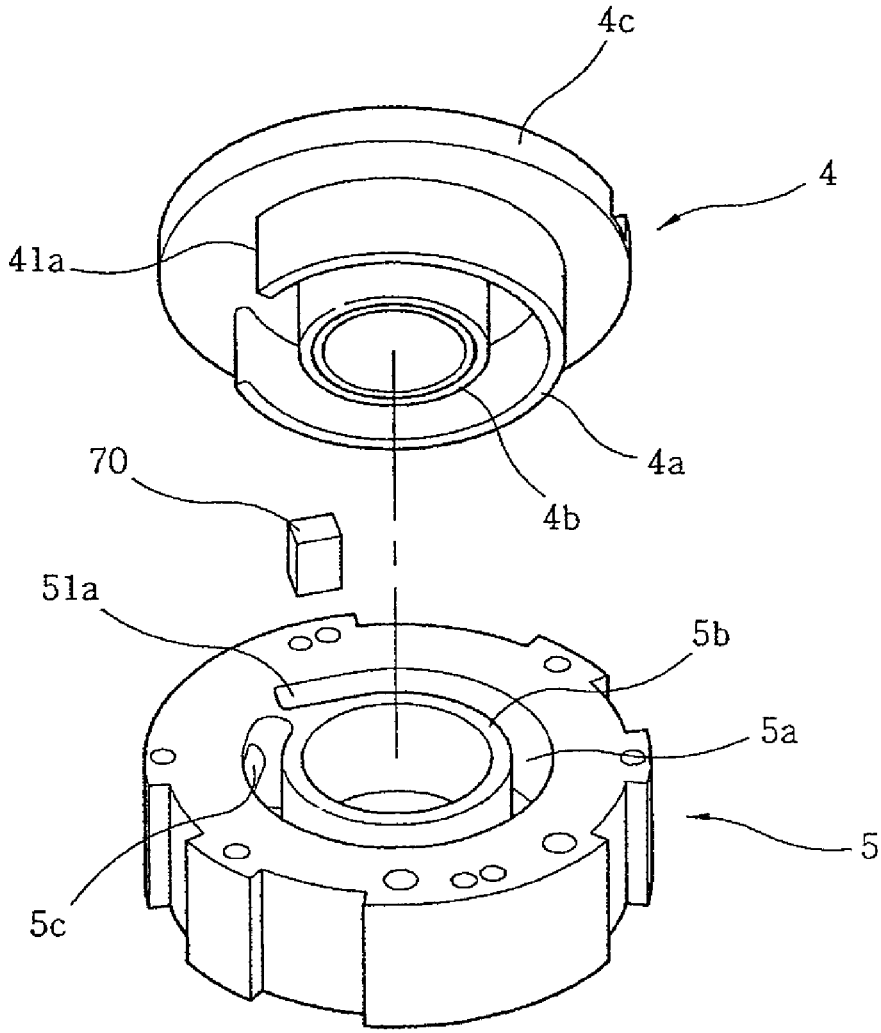
FIG. 2 is an exploded perspective view illustrating a compression unit of the conventional orbiting vane compressor.
Figure 3:
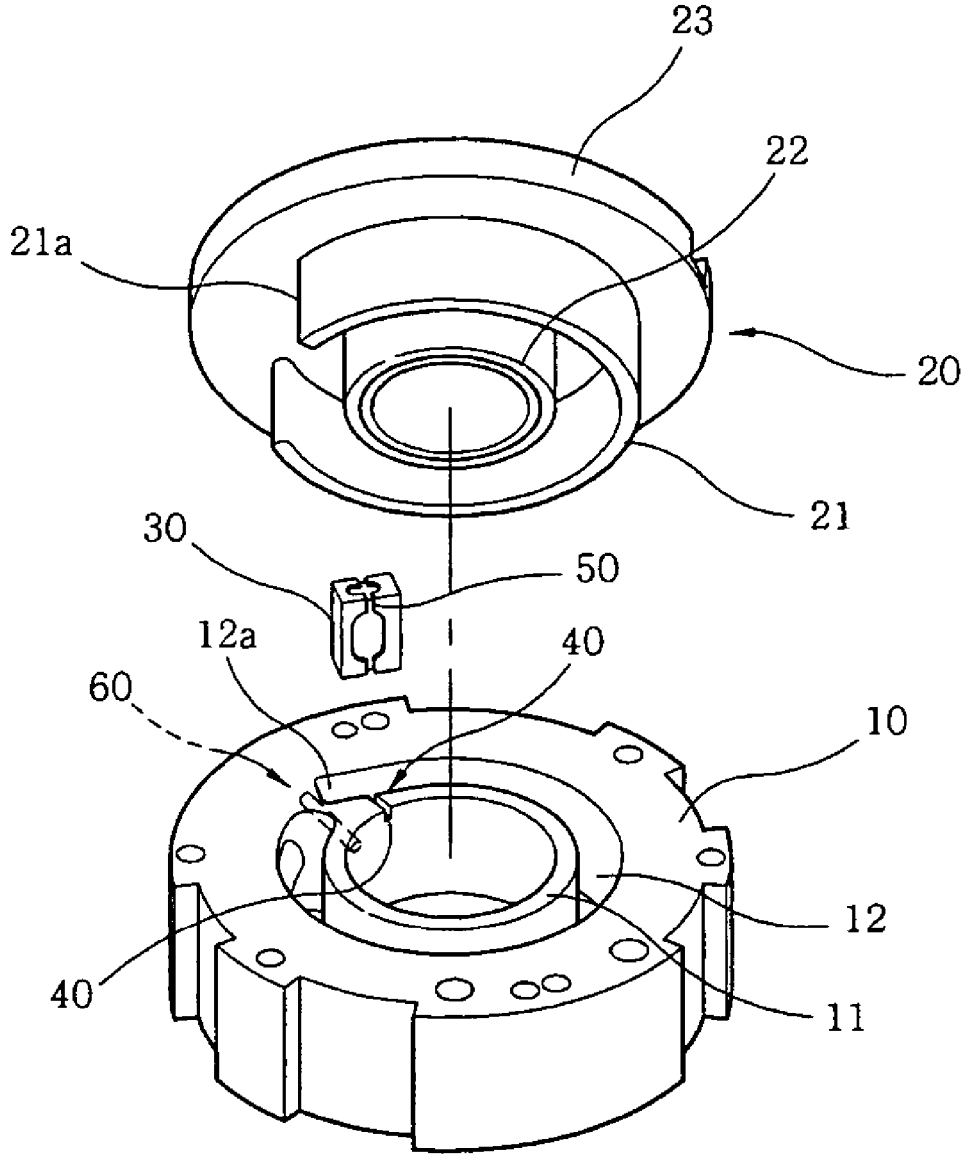
FIG. 3 is an exploded perspective view illustrating a compression unit of an orbiting vane compressor according to an embodiment of the present invention.
Figure 4:
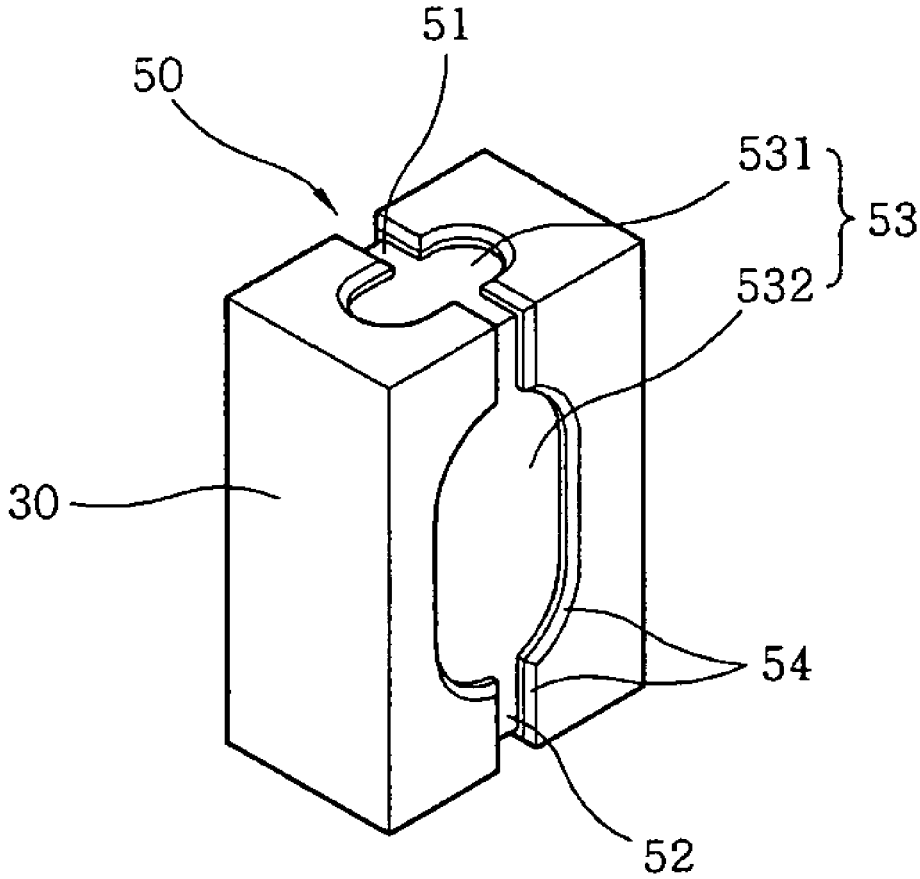
FIG. 4 is an enlarged perspective view of a slider of FIG. 3.

FIG. 3 is an exploded perspective view illustrating a compression unit of an orbiting vane compressor according to an embodiment of the present invention. FIG. 4 is an enlarged perspective view of a slider of FIG. 3.

Referring to FIGS. 3 and 4, the compression unit of the orbiting vane compressor comprises a cylinder 10 mounted in the lower region of the compressor, the cylinder 10 having an inner ring 11 and an annular space 12 defined between the inner ring 11 and the inner wall of the cylinder 10, an orbiting vane 20 inserted in the cylinder 10 to perform an orbiting movement, and a slider 30 inserted in a linear portion 12*a* of the annular space 12 to perform a reciprocating movement according to the orbiting movement of the orbiting vane 20. To supply oil to the slider 30 for the smooth reciprocating movement thereof, the present invention provides an oil supply structure, which comprises an oil supply slot 40 to supply oil to the outer surfaces of the slider 30, an oil groove portion 50 to guide the oil, supplied through the oil supply slot 40, along the outer surfaces of the slider 30, and an oil discharge channel 60 to discharge the oil, passed through the oil groove portion 50, to the outside of the cylinder 10.

The orbiting vane 20 has a circular vane 21 and a boss 22, which are inserted, respectively, into the annular space 12 and the inner ring 11 of the cylinder 10 in a state wherein a vane plate 23 of the orbiting vane 20 comes into contact with an upper surface of the cylinder 10. In such an inserted state, the circular vane 21 and the boss 22 perform orbiting movements inside the annular space 12 and the inner ring 11, respectively. Although not shown, a crankshaft of the compressor is fitted in the boss 22 to be inserted into the inner ring 11 of the cylinder 10. As the crankshaft (not shown) rotates, the orbiting vane 20 performs the orbiting movement to thereby compress refrigerant gas introduced into the cylinder 10.

During the orbiting movement of the orbiting vane 20, the slider 30, inserted in the linear portion 12*a* of the annular space 12, reciprocates linearly while being in contact with a linear lateral edge of the circular vane 21 defining an opening 21*a*.

The oil supply slot 40 of the oil supply structure is formed at an upper surface of the inner ring 11 to supply oil, filled in the inner ring 11, to the oil groove portion 50.

The oil, filled in the inner ring 11, is smoothly pumped according to the orbiting movement of the boss 22 inserted in the inner ring 11, thereby being introduced into the oil groove portion 50, formed at the outer surfaces of the slider 30, by way of the oil supply slot 40.

The oil groove portion 50 of the oil supply structure includes horizontal oil grooves 51 formed at upper and lower surfaces of the slider 30, and vertical oil grooves 52 formed at front and rear surfaces of the slider 30 to be connected to the horizontal oil grooves 51. The oil, supplied to the outer surfaces of the slider 30 by way of the oil supply slot 40, is guided along the oil groove portion 50 formed at the outer surfaces of the slider 30.

In this way, the oil is guided along the outer surfaces of the slider 30 by way of the horizontal oil grooves 51 and the vertical oil grooves 52 connected to the horizontal oil grooves 51, thereby providing effective lubrication to the outer surfaces, namely, reciprocating surfaces, of the slider 30 that come into contact with the inner wall of the cylinder 10 defining the annular space 12 and with the vane plate 23 of the orbiting vane 20. As a result, the reciprocating surfaces of the slider 30 are less affected by friction generated when the slider 30 reciprocates linearly.

The oil groove portion 50 further includes an oil storage 53. The oil storage 53 consists of horizontal storage grooves 531 formed at the upper and lower surfaces of the slider 30, and vertical storage grooves 532 formed at the front and rear surfaces of the slider 30. Here, the horizontal storage groove 531 is formed by enlarging the center of the horizontal oil groove 51, and the vertical storage groove 532 is formed by enlarging the center of the vertical oil groove 52.

The oil storage 53 provides a space for storing the oil flowing along the oil groove portion 50, and reduces the overall area of the reciprocating surfaces of the slider 30 as wide as the total area of the horizontal and vertical storage grooves 531 and 532 formed at the reciprocating surfaces of the slider 30 to thereby reduce the frictional area of the slider 30.

As stated above, the horizontal and vertical oil grooves 51 and 52 are formed along the outer surfaces of the slider 30 to be successively connected to one another. This provides uniform oil supply throughout the reciprocating surfaces of the slider 30.

The grooves 51, 52, 531 and 532 are recessed from the outer surfaces of the slider 30 to form an inclined wall surface 54 throughout the circumference of the grooves 51, 52, 531 and 532. The inclined wall surface 54 functions to facilitate the introduction of the oil into the grooves 51, 52, 531 and 532, or the discharge of the oil from the grooves 51, 52, 531 and 532 to the outer surfaces, namely, reciprocating surfaces of the slider 30.

The oil discharge channel 60 is perforated through the cylinder 10 at the lower end of the linear portion 12*a* of the annular space 12 corresponding to the lower end of the oil groove portion 50 formed at the slider 30.

By passing through the oil discharge channel 60, the oil, passed through the oil groove portion 50 of the slider 30, is discharged from the annular space 12 to the outside of the cylinder 10.

Figure 5:
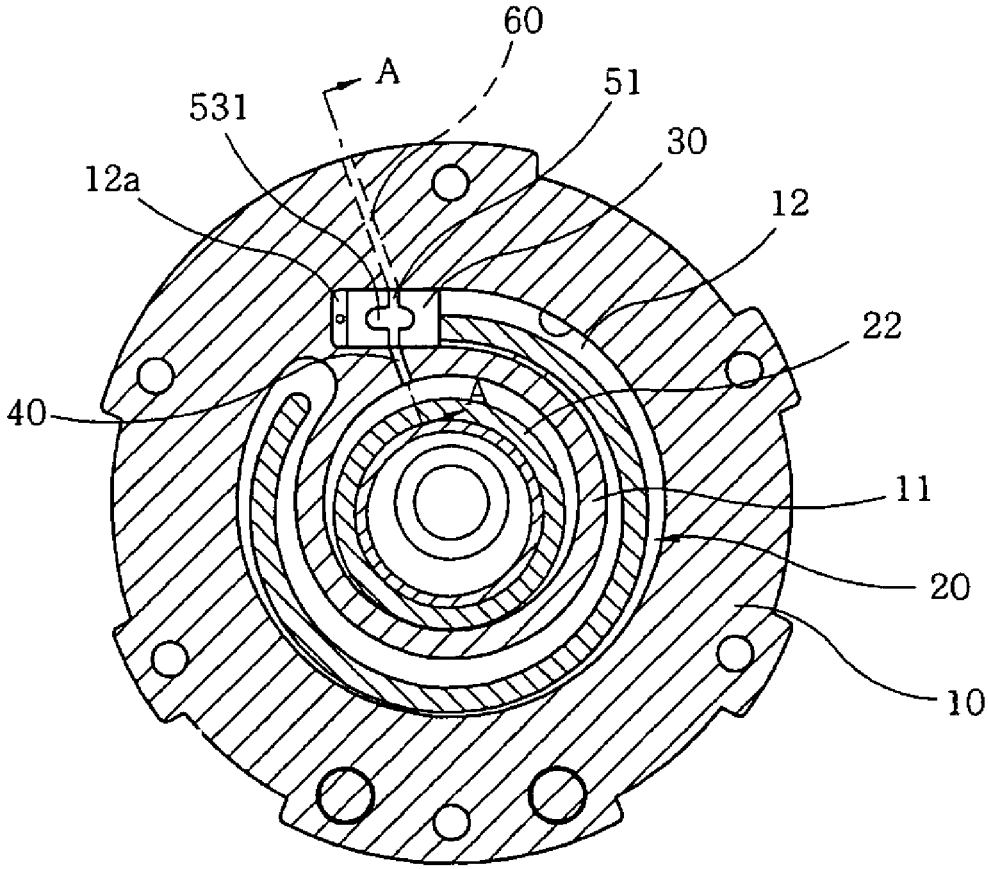
FIG. 5 is a cross sectional view of the compression unit of FIG. 3, in an assembled state.
Figure 6:
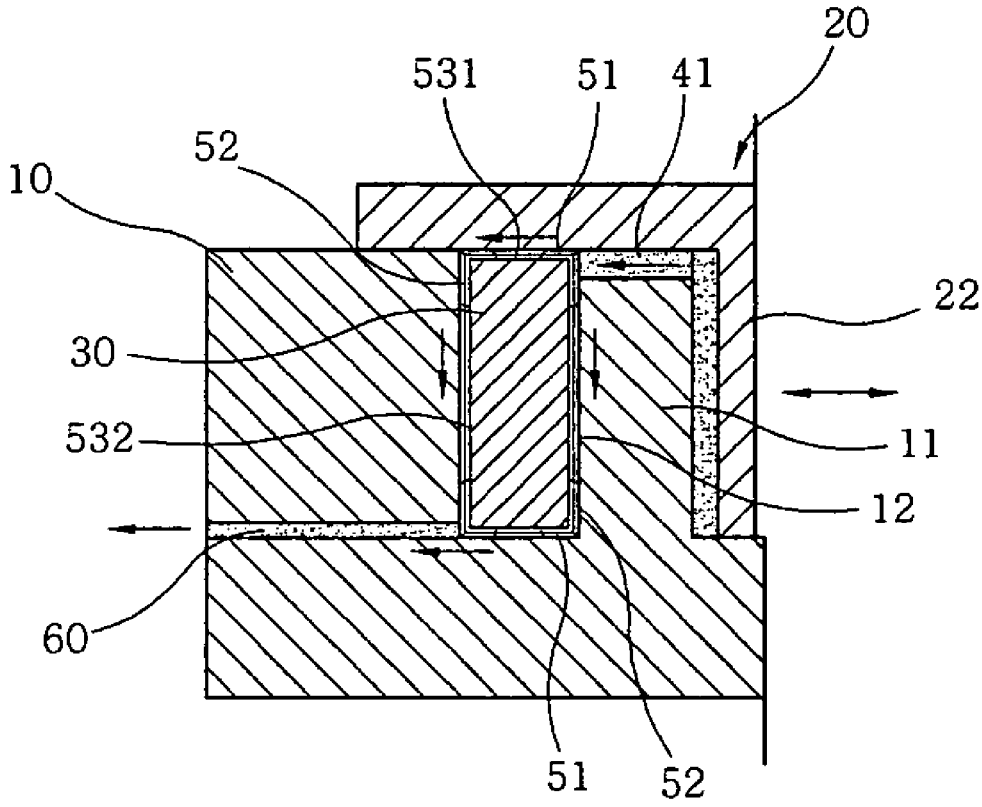
FIG. 6 is a sectional view taken along line A-A of FIG. 5.

FIG. 5 is a cross sectional view of the compression unit of FIG. 3, in an assembled state. FIG. 6 is a sectional view taken along line A-A of FIG. 5.

Referring to FIGS. 5 and 6, as the boss 22 of the orbiting vane 20, inserted in the inner ring 11 of the cylinder 10, performs an orbiting movement, the oil filled in the inner ring 11 is pumped.

Thereby, the oil filled in the inner ring 11 is introduced into the annular space 12 through the oil supply slot 41, and simultaneously, is introduced into the horizontal and vertical oil grooves 51 and 52 of the slider 30, which is inserted in the linear portion 12*a* of the annular space 12.

In the embodiment of the present invention, the oil supply slot 41 formed at the cylinder 10 is positioned lower than the horizontal oil groove 51 formed at the upper surface of the slider 30. This allows the oil, supplied through the oil supply slot 41, to be first introduced and filled in the vertical oil groove 52 formed at the front surface of the slider 30, and sequentially be introduced into the horizontal oil groove 51.

In other words, by virtue of a height difference between the oil supply slot 40 and the horizontal oil groove 51, the oil, supplied through the oil supply slot 41, can be first introduced into the vertical oil groove 52 and sequentially be introduced into the horizontal oil groove 51, thereby being smoothly supplied to both the horizontal and vertical oil grooves 51 and 52.

The oil, introduced into the horizontal and vertical oil grooves 51 and 52 as stated above, is guided along the horizontal and vertical oil grooves 51 and 52, which are successively formed along the outer surfaces of the slider 30, while being partially stored in the horizontal and vertical storage grooves 531 and 532, thereby providing effective lubrication to the outer surfaces of the slider 30.

The oil, used in the lubrication of the outer surfaces of the slider 30, is discharged to the outside of the cylinder 10 by way of the oil discharge channel 60, which is perforated through the cylinder 10 at the position corresponding to the lower end of the annular space 12 and the ends of the horizontal and vertical oil grooves 51 and 52.

As apparent from the above description, the present invention provides an oil supply structure for a slider of an orbiting vane compressor having several advantageous effects as follows.

First, the oil supply structure of the present invention provides effective lubrication to reciprocating surfaces of the slider reciprocating in an annular space of a compressor cylinder to thereby reduce friction between the slider and the compressor cylinder, resulting in improved compressor reliability and performance.

Second, the oil supply structure of the present invention allows lubricant oil to be smoothly supplied from an inner ring to the slider as a boss of an orbiting vane inserted in the inner ring performs an orbiting movement. Thereby, the oil can be supplied according to a compressing operation of the compressor, enabling more stable lubrication of the slider.

Third, according to the present invention, the oil can be smoothly guided along the overall reciprocating surfaces of the slider, achieving uniform lubrication of the slider.

Fourth, the oil, used in the lubrication of the slider, can be smoothly discharged to the outside of the cylinder. This has the effect of preventing oil accumulation in the annular space around the slider.

Finally, as a result of forming the slider to store the oil supplied thereto, it is possible to achieve continuous lubrication of the slider and to reduce the total area of the reciprocating surfaces of the slider, achieving more stable lubrication of the slider and reducing the frictional area between the slider and the cylinder.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A slider of an orbiting vane compressor comprising:

horizontal oil grooves provided at upper and lower surfaces of the slider, the horizontal oil grooves being configured to guide oil along outer horizontal surfaces of the slider, and at least one horizontal storage groove communicating with a corresponding horizontal oil groove, the at least one horizontal storage groove comprising an enlargement of a mid-portion of the corresponding horizontal oil groove; and vertical oil grooves provided at front and rear surfaces of the slider, the vertical oil grooves being configured to guide oil along outer vertical surfaces of the slider, and at least one vertical storage groove communicating with a corresponding vertical oil groove, the at least one vertical storage groove comprising an enlargement of a mid-portion of the corresponding vertical oil groove.

2. The slider as set forth in claim 1, further comprising:

an inclined wall surface provided between bottom surfaces of the horizontal oil grooves, the at least one horizontal storage groove, and the outer surfaces of the slider.

3. An oil supplier of a slider of an orbiting vane compressor, the compressor comprising:

a cylinder having an annular space defined between an inner ring and an inner wall of the cylinder;

an orbiting vane having a circular vane positioned within the annular space, and a boss positioned within the inner ring of the cylinder, the orbiting vane being configured to move orbitally within the annular space so that refrigerant gas introduced into the cylinder is compressed in accordance with a rotating movement of a crankshaft of the compressor; and the slider being positioned within the annular space, the slider being configured to move reciprocally within the annular space so that a lateral surface of the slider contacts a lateral edge of the circular vane which defines an opening of the circular vane, wherein the oil supplier comprises:

an oil supply slot configured to supply oil to upper, lower, front and rear surfaces of the slider, horizontal oil grooves provided at upper and lower surfaces of the slider, the horizontal oil grooves being configured to guide oil along outer horizontal surfaces of the slider, and at least one horizontal storage groove communicating with a corresponding horizontal oil groove, the at least one horizontal storage groove comprising an enlargement of a mid-portion of the corresponding horizontal oil groove, and vertical oil grooves provided at front and rear surfaces of the slider, the vertical oil grooves being configured to guide oil along outer vertical surfaces of the slider, and at least one vertical storage groove communicating with a corresponding vertical oil groove, the at least one vertical storage groove comprising an enlargement of a mid-portion of the corresponding vertical oil groove.

4. The structure as set forth in claim 3, wherein:

the annular space has a linear portion provided at one end; and the slider being positioned within the linear portion, the slider being configured to linearly reciprocate in accordance with the orbiting movement of the orbiting vane.

5. The structure as set forth in claim 3, wherein the crankshaft is coupled to the boss which is positioned radially within the circular vanes, the crank shaft being positioned within the inner ring of the cylinder.

6. The structure as set forth in claim 3, further comprising:

an oil discharge channel configured to discharge the oil, which is guided along the upper, lower, front and rear surfaces of the slider, to an outside of the cylinder.

7. The structure as set forth in claim 6, wherein the oil discharge channel extends through the cylinder so as to communicate with a lower end of the annular space corresponding to the lower surface of the slider.

8. The structure as set forth in claim 3, wherein the oil supply slot is provided at an upper surface of the inner ring of the cylinder so that oil the which accumulates within the inner ring is pumped and supplied to the upper, lower, front and rear surfaces in accordance with an orbiting movement of the orbiting vane.

9. The structure as set forth in claim 3, wherein an inclined wall surface is formed between bottom surfaces of the oil grooves, the storage grooves, and the upper, lower, front and rear surfaces of the slider.

10. The structure as set forth in claim 3, wherein the oil supply slot is positioned lower than the horizontal oil groove in a vertical direction of the slider.

* * * * *